United States Patent [19]

Maringer

[11] Patent Number: 4,658,885

[45] Date of Patent: Apr. 21, 1987

[54] METHOD OF REPETITIOUSLY MARKING CONTINUOUSLY CAST METALLIC STRIP MATERIAL

[75] Inventor: Robert E. Maringer, Worthington, Ohio

[73] Assignee: Battelle Development Corporation, Columbus, Ohio

[21] Appl. No.: 148,448

[22] Filed: May 9, 1980

[51] Int. Cl.[4] ..... B22D 11/00

[52] U.S. Cl. ..... 164/463

[58] Field of Search ..... 164/87, 150, 423, 427, 164/429, 437, 138, 133, 335, 418, 463

[56] References Cited

U.S. PATENT DOCUMENTS

| | | | |
|---|---|---|---|
| 905,758 | 12/1908 | Strange et al. | 164/427 |
| 993,904 | 5/1911 | Strange | 164/427 |
| 3,964,963 | 6/1976 | Anderson | 164/87 X |
| 4,142,571 | 3/1979 | Narasimhan | 164/87 X |
| 4,212,343 | 7/1980 | Narasimhan | 164/87 X |

*Primary Examiner*—Nicholas P. Godici

*Attorney, Agent, or Firm*—Patrick J. Viccaro

[57] ABSTRACT

A method of producing a mark onto a continuously cast metallic strip is disclosed comprising the steps of providing a continuous surface upon which metal strip is cast from a molten metal holding tundish having a nozzle disposed less than about 0.120 inch from the casting surface. The casting surface is cooled and is moved past the nozzle at a rate of about 200 to 10,000 linear surface feet per minute. This method includes providing an impression in the continuous casting surface corresponding to the mark to be produced onto the continuously cast metal strip. Molten metal is continuously fed through the nozzle onto the moving continuous casting surface to produce continuously cast strip thereon, and the cast strip is continuously removed from the casting surface.

3 Claims, 6 Drawing Figures

METHOD OF REPETITIOUSLY MARKING CONTINUOUSLY CAST METALLIC STRIP MATERIAL

BRIEF SUMMARY OF THE INVENTION

Incorporated herein, by reference, is the subject matter of co-filed U.S. patent applications entitled "Strip Casting Apparatus", Ser. No. 148,421 abandoned; "Method and Apparatus for Strip Casting", Ser. No. 148,359 now U.S. Pat. No. 4,617,981; "Apparatus for Strip Casting", Ser. No. 148,440 abandoned; and "Strip Casting Nozzle", Ser. No. 148,441 abandoned, all of which were filed May 9, 1980 and are assigned to the assignee of the present application.

The present invention relates to the continuous casting of metallic strip, and more particularly, to a method of producing a repetitious mark onto a continuously cast metallic strip.

The general concept of casting thin metallic materials such as sheet, foil, strip and ribbon was disclosed in the early 1900's. For example, U.S. Pat. Nos. 905,758 and 993,904 teach processes wherein molten metal flows onto a moving cool surface and solidifies thereon into a continuous thin strip. These early references teach that molten metal may be poured onto the smooth peripheral surface of a rotating liquid-cooled copper drum or disc to form strip materials.

Strip casting is now receiving increased technical attention with the objective of developing a commercially acceptable operation. The present invention is particularly directed to a development which shall contribute to the commercial success of strip casting.

Regardless of the method employed for producing strip material, processes must be utilized for identifying or marking the strip, for cutting or slitting the strip, and for otherwise affecting the surface conditions and, perhaps the quality, of the strip, and the like. Strip produced by conventional rolling techniques is subjected to stamping, pressing, trimming, slitting and other operations. Likewise, strip which is continuously cast may also be subjected to these conventional supplemental operations. However, such supplemental operations require additional time in coiling, uncoiling, passing the strip through the auxiliary equipment, performing the auxiliary operation and recoiling the strip.

Accordingly, a new and improved method of marking the surface of continuously cast strip material is desired which eliminates the need for performing supplemental marking operations by incorporating the marking operation into the casting operation.

The present invention may be summarized as a method of producing a mark onto a continuously cast metallic strip comprising the steps of providing a continuous surface upon which metal strip is cast from a molten metal holding tundish having a nozzle disposed less than about 0.120 inch from the casting surface. In this invention the casting surface is cooled and is moved past the nozzle at a rate of about 200 to 10,000 linear surface feet per minute. This method includes providing an impression in the continuous casting surface corresponding to the mark to be produced onto the strip material. Molten metal is continuously fed through the nozzle onto the moving casting surface to produce continuously cast strip thereon, and the cast strip is continuously removed from the casting surface.

Among the advantages of the present invention is the provision of a method for marking strip material as it is being continuously cast, without adversely affecting strip product quality and uniformity.

An objective of the present invention is to provide a method of intentionally marking strip material in conjunction with the casting operation to obviate the necessity of performing supplemental marking operations.

An advantage of the present invention is that marks indicative of such variables as alloy type, strip, trademark or trade name, product designation, casting direction, and the like, may be repetitiously impressed into the strip without adversely affecting the quality and uniformity of the strip material.

A further objective of this invention is to provide a method of transversely imprinting continuously cast silicon steel in order to enhance the magnetic properties thereof.

Another advantage of the present invention is that an impression may be provided transversely across the width of the strip at sufficient depth to cut the continuously cast strip into equal length strips during casting without adversely affecting the quality or uniformity of the strip material.

These and other objectives and advantages of the present invention will be more fully understood and appreciated with reference to the following detailed description and the accompanying drawings.

DETAILED DESCRIPTION

Figure 1:
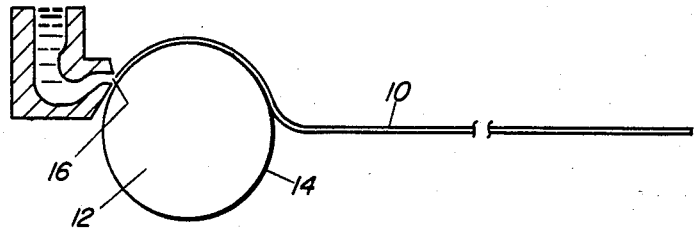
FIG. 1 is an elevation view, partially in cross-section, illustrating a typical apparatus used for continuously casting strip material.

Referring particularly to the drawings, FIG. 1 generally illustrates an apparatus for casting metallic strip material 10. This apparatus includes an element 12 upon which the strip is cast. In a preferred embodiment, strip is cast onto a smooth, outer peripheral surface 14 of a circular drum or wheel as shown in FIG. 1. It should be understood that configurations other than circular may be employed. For example, a wheel with a smooth, frustoconical outer peripheral surface (not shown) may be utilized. Also, a belt, rotatable in a general ovular path may be employed as a continuous casting surface.

In a preferred embodiment, the casting element 12 comprises a water cooled, precipitation hardened copper alloy wheel containing about 98% copper and about 2% chromium. Copper and copper alloys are chosen for their high degree of thermal conductivity, however, berillium copper alloys, steel, brass, aluminum, aluminum alloys or other materials may also be utilized alone or in combination with other materials. Likewise, cooling may be accomplished other than by supplying water thereto. Water is typically chosen in a preferred embodiment because of its low cost and ready availability.

In the operation of the casting unit shown in FIG. 1, the surface 14 of the rotatable casting wheel 12 must be able to absorb the heat generated by contact with molten metal at the initial casting point 16, and such heat must be conducted substantially into the wheel 12 during each rotation thereof. The initial casting point 16 refers to the approximate location on the casting surface 14 where molten metal 20 from the tundish 22 first contacts the casting surface 14. Cooling by heat conduction may be accomplished by delivering relatively large quantities of water through internal passageways located near the periphery of the casting wheel 12. Alternatively, the cooling medium may be delivered directly to the underside of the casting surface. Understandably, refrigeration techniques and the like may be employed to accelerate or decelerate the cooling rates as may be desired during strip casting.

Whether a drum, wheel or belt is employed for casting, the casting surface 14 is generally smooth and symmetrical to maximize product surface uniformity in strip casting. It should also be understood that if the casting element is a drum or a wheel, the element should be carefully constructed so as not to be out-of-round during operation to further insure uniformity in strip casting. Along these lines, it has been found that a drum or wheel which is out-of-round by about 0.020 inch, or more, may have a magnitude of dimensional instability which, unless corrected or compensated during operation, may be unacceptable for certain strip casting operations. It has been found that acceptable dimensional symmetry, as well as the elimination of problems associated with weld porosity, may be more readily accomplished by fabricating a casting wheel or drum from a single, integral slab of cold rolled or forged copper alloy. However, as mentioned above, alternative materials such as sleeves or coatings may be employed.

The drive system and housing for the drum, wheel or other casting surface 14 of the present invention should also be rigidly constructed to permit drum rotation without structural instability which could cause the drum to slip or vibrate. In particular, care should be taken to avoid resonant frequencies at the operating speeds for the drum. The casting surface should be capable of moving at surface speed of from about 200 linear surface feet per minute to more than about 10,000 linear surface feet per minute. When utilizing a drum having a circumference of about 8 feet, this rate calculates to a drum speed of about 25 rpm to about 1,250 rpm. A three-horse power variable speed reversible, dynamically braked motor provides an adequate drive system for an integral copper casting drum about two inches thick and about eight feet in circumference. It should be understood that larger motors may be required to drive larger casting drums.

The casting surface 14 on the wheel or drum of the apparatus of the present invention should be generally smooth in texture. It has been found that in certain applications for producing amorphous materials, finishing the peripheral surface 14 of a casting drum 12 with 400-grit paper and preferably with 600-grit paper may yield improved product uniformity. Alternatively, the drum surface may be finished in a lathe, or the like.

In accordance with the present invention, it has been found that a surface impression may be intentionally provided in or on the casting surface without detrimentally affecting the uniformity and quality of the strip material continuously cast thereon. Such product uniformity and quality is retained even though a reflection of the impression provided in the continuous cast surface is transposed onto the continuously cast strip material.

Figure 5:
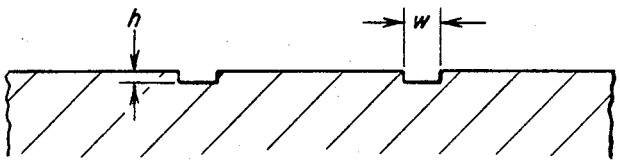
FIG. 5 is an enlarged cross-sectional view of a depression in a casting surface.
Figure 6:
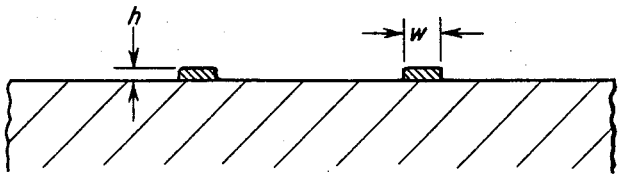
FIG. 6 is an enlarged cross-sectional view of an embossed casting surface.

In a preferred embodiment, the impression in the continuous casting surface comprises an indentation in the casting surface. However, it should be understood that in certain applications the impression in the continuous casting surface may comprise an embossment on the casting surface. Whether an indentation or an embossment is provided in the casting surface, such impression should deviate at a depth d, or a height h, of at least 0.00005 inch from the general plane of the casting surface and at a width w of at least 0.001 inch, as best shown in FIGS. 5 and 6, in order for such impression to be transposed onto the continuously cast strip material during casting. It has been found that continuously cast strip material which is cast over impressions having such dimensional deviation from the casting surface bear enough of a deviation in surface reflectivity in the strip to be clearly visible to the ordinary observer. More preferably, such impression should deviate at a height h or a depth d of at least 0.0001 inch from the general plane of the casting surface and at a width w of at least 0.002 inch.

Figure 2:
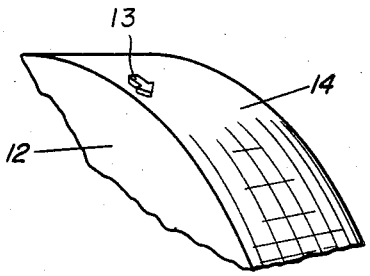
FIG. 2 is a perspective view of a portion of a casting surface having an impression therein.
Figure 3:
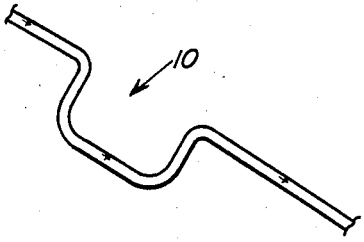
FIG. 3 is a perspective view of strip material cast on the surface shown in FIG. 2 bearing the impression from the casting surface.

A multitude of different types of impressions may be provided in a continuous casting surface in accordance with the method of the present invention. For example, an impression in the shape of an arrow 13 may be provided in a casting surface, as shown in FIG. 2, which is indicative of the strip casting direction. Transposition of such impression onto the strip, as shown in FIG. 3, material aids in the analysis of such material. Also, impressions may be provided in the casting surface to indicate the type of alloy being cast, casting number, heat number, and various other product designations. Such other product designations may include trademarks or trade names for the cast strip material, shipping designations, customer designations and the like.

Another type of impression which may be provided in continuously cast strip material is a dimple. Dimples, cast over generally semicircular indentations or embossments in the casting surface, may be intermittently provided in continously cast strip material to serve as spacing devices when such material is assembled in successive layers such as is found in transformer cores, catalytic converters, and rotating regenerators.

Figure 4:
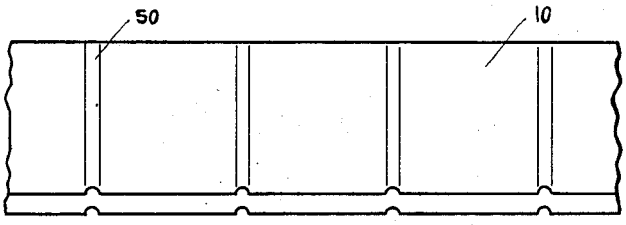
FIG. 4 is a perspective view of strip material bearing repetitious transverse impressions thereon.

In the production of certain strip material, such as silicon steel strip material typically for electrical applications, it has been found that markings, such as the lines 50 shown in the strip material 10 in FIG. 4, disposed substantially transverse to the casting direction may enhance the magnetic properties of such strip material. In accordance with the present invention, markings such as the lines 50 shown in FIG. 4, substantially transverse to the casting direction of the strip, may be provided during casting to enhance the magnetic properties of such strip material. More particularly, such transverse markings result in lower core losses when such material is used in electrical applications. The present invention provides a simplified and convenient method of obtaining such improved results, in process.

It has also been found that an impression which deviates at least about 0.0001 inch from the general plane of the casting surface, and having a width of at least 0.002 inch, may substantially completely interrupt the continuity of the cast strip at such impression. Such impression is suitable to cut the strip into predetermined length strips, at least, for strip having a thickness, or gage, of less than about 0.010 inch, typically in the range of about 0.003 to 0.008 inch. Therefore, for such transverse impressions, each time that such impression passes the initial casting point 16 the impression may act to cut the strip into a number of repetitious strips each having a length corresponding to the surface distance on the casting surface from impression to impression. It should be understood that the strip may be able to be continuously cut in the longitudinal direction by the present invention. It should be noted that the depth d or height h of the impression necessary to cut the strip may depend, in part, on the thickness of the strip being cast.

A number of methods may be employed to provide the impression in the continuous casting surface in accordance with the present invention. For example, when copper, copper alloys, aluminum, brass, and the like are utilized as the casting surface, the impression may be indented into the casting surface with the use of a stylus having a generally sharp point. It has been found that a stylus with a radiused point, such as a ball point pen, may be used to provide a suitable indentation in the casting surface. As discussed above, suitable indentations are those having a width of at least 0.001 inch and a depth d or height h of at least 0.00005 inch. Preferred casting surface materials are malleable and, therefore, the indentation may be readily provided therein with manual pressure.

In an alternative embodiment of the present invention the impression may take the form of an embossment on the casting surface 14. It should be appreciated that such embossment may comprise a material which is dissimilar to that of the casting surface. For example, it may be desirable to roll, stamp or otherwise imprint an embossment or embossments onto the casting surface 14 as the casting surface 14 rotates. Such imprint may consist of wax, ink, dye or the like which provides the necessary dimensional deviation from the casting surface 14, i.e., a height h of at least 0.00005 inch and a width of at least 0.001 inch. It will be understood that such imprinted embossment may be removed on account of the high temperatures to which it is subjected, the force of a doctor blade, or the like, used to assist the strip from the casting surface, and other conditions. Therefore, it may be necessary to repetitiously or intermittently reapply the imprinted embossment onto the casting surface as may be desired.

In the operation of the method of the present invention, an impression is provided in the continuous casting surface which corresponds to the mark to be transposed onto the continuously cast strip material. By continuously feeding molten metal through the nozzle in a continuous casting device, onto the moving continuous casting surface, and over the impression as the impression passes the nozzle, such impression is continuously transposed onto the strip material. Understandably, for a repetitious impression or impressions in a casting surface the impression is repeatedly transposed onto the strip each time the impressed casting surface passes the nozzle orifice. It should be noted that such transposed impression may appear on both sides of the strip material. Such two sided impression is common when the strip material has a gage of less than about 0.010 inch. Although the prior art teaches that surface irregularities may be detrimental to uniformity and quality of cast strip material, it is the speed of continuous casting which is at least in part responsible for maintaining and perhaps enhancing the uniformity and quality of rapidly cast strip material in the presence of such irregular surface impressions.

Whereas the preferred embodiment has been described for the purposes of illustration, it will be apparent to those skilled in the art that numerous variations of the details may be made without departing from the invention.

I claim:

1. A method of producing a mark onto a continuously cast strip of metal comprising the step of:

providing a continuous surface upon which metal strip is cast from a molten metal holding tundish having a nozzle disposed less than about 0.120 inch from said surface, said surface cooled to a temperature below the solidus temperature of the molten metal, said surface movable past the nozzle at a rate of from about 200 to about 10,000 feet per minute, providing an impression in the continuous casting surface corresponding to the mark to be produced onto the continuously cast metal strip, said impression deviating at least 0.0001 inch from the casting surface and being an embossment of a material dissimilar to the casting surface, continuously feeding molten metal through the nozzle onto the moving continuous casting surface and over the impression as said impression passes said nozzle, to produce continuously cast strip thereon, completely and intermittently interrupting the continuity of the cast strip at such impression into a number of repetitious strips each having a length corresponding to the surface distance on the casting surface from impression to impression, and continuously removing the cast strip from the continuous casting surface.

2. A method of producing a mark onto a continuously cast strip of metal comprising the steps of:

providing a continuous surface upon which metal strip is cast from a molten metal holding tundish having a nozzle disposed less than about 0.120 inch from said surface, said surface cooled to a temperature below the solidus temperature of the molten metal, said surface movable past the nozzle at a rate of from about 200 to about 10,000 feet per minute, providing an impression in the continuous casting surface corresponding to the mark to be produced onto the continuously cast metal strip, said impression deviating at least 0.0001 inch from the casting surface and being an embossment of a material selected from the group consisting of wax, ink and dye, continuously feeding molten metal through the nozzle onto the moving continuous casting surface and over the impression as said impression passes said nozzle, to produce continuously cast strip thereon, completely and intermittently interrupting the continuity of the cast strip at such impression into a number of repetitious strips each having a length corresponding to the surface distance on the casting surface from impression to impression, and continuously removing the cast strip from the continuous casting surface.

3. A method of producing a mark onto a continuously cast strip of metal comprising the steps of:

providing a continuous surface upon which metal strip is cast from a molten metal holding tundish having a nozzle disposed less than about 0.120 inch from said surface, said surface cooled to a temperature below the solidus temperature of the molten metal, said surface movable past the nozzle at a rate of from about 200 to about 10,000 feet per minute, providing impressions in the continuous casting surface corresponding to the mark to be produced onto the continuously cast metal strip, one said impression deviating sufficiently from the casting surface to result in transposing the impression into a surface reflective mark in the metal strip cast thereon, and being in the shape of an arrow indicative of the strip casting direction, continuously feeding molten metal through the nozzle onto the moving continuous casting surface and over the impression as said impression passes said nozzle, to produce continuously cast strip thereon, completely and intermittently interrupting the continuity of the cast strip at another said impression which traverses the casting surface into a number of repetitious strips each having a length corresponding to the surface distance on the casting surface, from impression to impression, and continuously removing the cast strip from the continuous casting surface.

* * * * *